United States Patent [19]

Andersen et al.

[11] 3,936,624

[45] Feb. 3, 1976

[54] MULTIFINGER CONTACT

[75] Inventors: Stephen Verner Andersen, Burbank, Calif.; Edwin Grant Swick, Bartlett, Ill.

[73] Assignee: Illinois Tool Works Inc., Chicago, Ill.

[22] Filed: Mar. 4, 1974

[21] Appl. No.: 447,612

[52] U.S. Cl. ..... 200/283; 200/246; 29/630 E; 338/202

[51] Int. Cl.[2] ..... H01C 1/12; H01H 1/28

[58] Field of Search ..... 338/202; 200/283, 164 R, 200/164 A, 246; 29/630 E

[56] References Cited

UNITED STATES PATENTS

| | | | |
|---|---|---|---|
| 3,274,368 | 9/1966 | DeBoo et al. | 29/630 E X |
| 3,569,897 | 3/1971 | Laube et al. | 338/183 |
| 3,676,823 | 7/1972 | Fujii et al. | 338/202 X |
| 3,704,436 | 11/1972 | Froebe et al. | 338/202 |
| 3,733,573 | 5/1973 | Dietrich | 338/202 |

*Primary Examiner*—James R. Scott
*Assistant Examiner*—William J. Smith
*Attorney, Agent, or Firm*—T. W. Buchman; R. W. Beart

[57] ABSTRACT

A multifinger contact device is produced by a series of deforming stations which compress the fingers into die cavities decreasing the width of the fingers while severing the adjacent fingers from one another, by deforming the adjacent fingers first in one direction and then in the other to decrease the formation of burrs. A subsequent forming station may be utilized to confine the entire periphery of the finger so as to form opposing longitudinal edges on adjacent fingers into non-contacting curved surfaces.

2 Claims, 7 Drawing Figures

MULTIFINGER CONTACT

BACKGROUND OF THE INVENTION

The invention relates generally to multifinger electrical contact members, such as that used in potentiometers.

One commonly used method of producing multifinger contacts of the type used in potentiometers is to wind conductive wire about a drum, plate and selectively remove the plating to produce a plurality of severable brush blanks, each having a plated portion serving as a base interconnecting individual finger portions. This practice necessarily involves several complicated and expensive steps. Another approach used to produce multifinger contacts is to merely slot a sheet of conductive material to provide a plurality of individual contact members separated by a relatively large space between adjacent edges. Understandably, this product will not practically produce a dense arrangement of individually flexible fingers as is required for microminiature environments, such as in potentiometers. Straight shearing of fingers from one another has been found to produce unacceptable contact members because the fingers will not flex independently since they will remain in substantial lateral contact with each other.

SUMMARY OF THE INVENTION

The present invention produces a novel, integral multifinger contact member in which each finger may be independently flexed. The method utilized incorporates a series of deforming stations which includes two successive stations wherein alternate finger portions are deformed to decrease the thickness thereof by coacting tool faces, each face including die cavities and punch members adapted to cooperate with one another to move adjacent fingers transverse the plane of the stock and relative to each other during the compression into the die cavities. A second such station reverses the movement of the fingers so they are completely sheared from one another in a manner wherein sharp burrs are eliminated at the longitudinal edges of the fingers. Subsequent forming stations may be utilized to return the fingers to a coplanar position as well as completely confining the fingers from contact with each other. The subsequent forming stations may also deform the opposing edge surfaces of the fingers into a curved surface thus further minimizing the risk of substantial lateral contact between adjacent fingers which would prevent independent flexing.

It is, therefore, an object of the invention to provide a method of making integral multifinger contacts in which each finger will flex independently of the other.

Yet another object of the invention is to provide an apparatus wherein elongate portions of a conductive sheet material are compressed into die cavities to decrease the width and eliminate contact between adjacent fingers along their lengths.

An advantage of the present invention is the formation of a plurality of fingers on an integral contact member with opposing side surfaces which restrict contact between one another.

Other objects and advantages of the present invention will become apparent from a consideration of the following description in conjunction with the accompanying drawings in which;

DESCRIPTION OF THE PREFERRED EMBODIMENT

Figures 1, 2, 3, 4, 5, 6, 7:
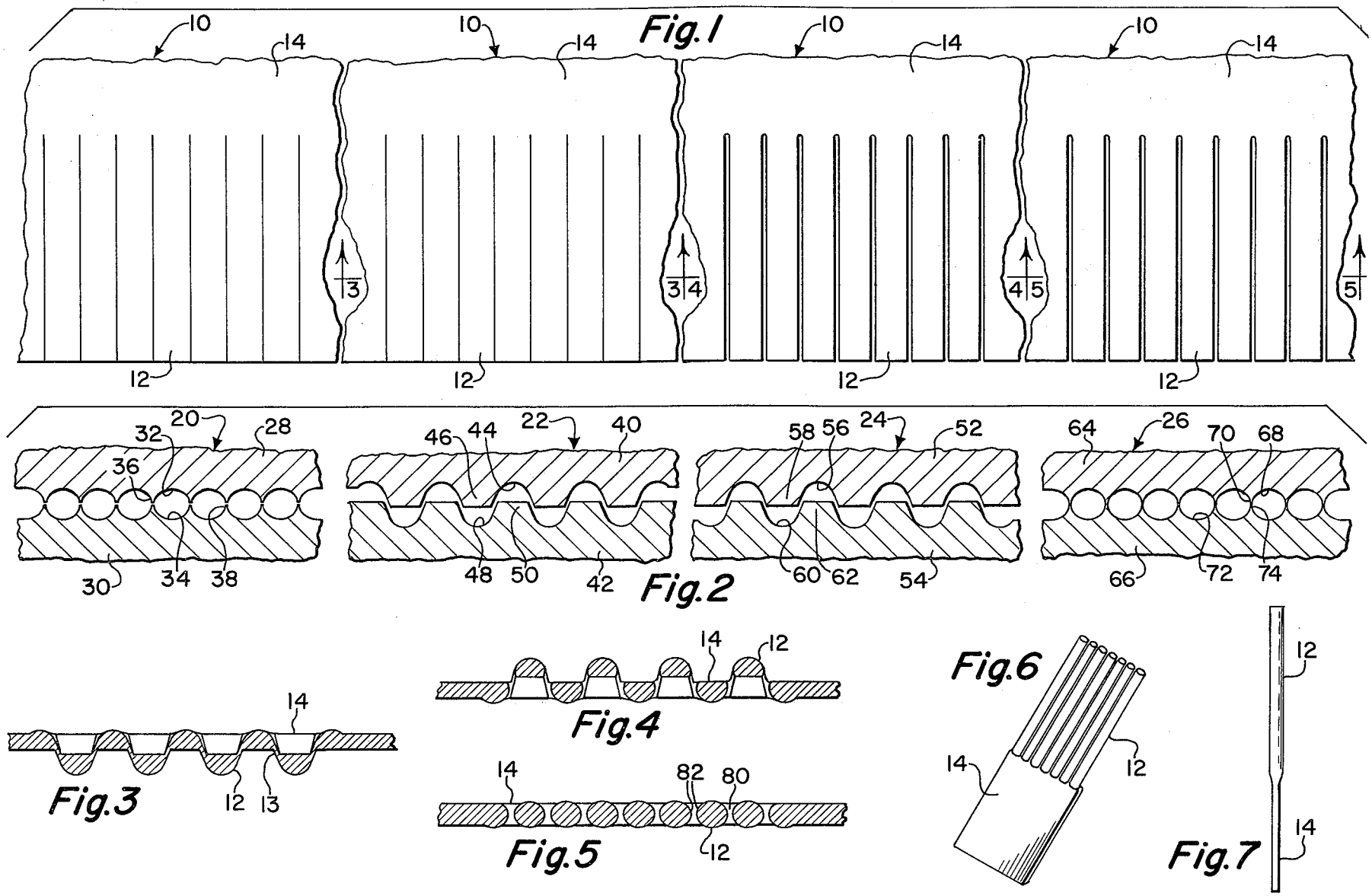
FIG. 1 is a fragmentary plan view showing a series of deformations effected along a metal strip in accordance with the principles of the invention.
FIG. 2 is a cross-sectional view of opposing tool faces in mating condition at four successive forming stations of the invention and which relate to the four successive deformed portions of the strip in FIG. 1.
FIG. 3 is a cross-sectional view of the strip along lines 3—3 of FIG. 1 and showing the condition of the strip as a result of the second working station.
FIG. 4 is a cross-sectional view of the deformed strip taken along lines 4—4 of FIG. 1 and showing the condition of the strip after the third working station.
FIG. 5 is a cross-sectional view of the fully formed fingers taken along lines 5—5 of FIG. 1 and showing the condition of the strip after the fourth working station.
FIG. 6 is a perspective view of a contact element made in accordance with the invention.
FIG. 7 is a side view of the contact element shown in FIG. 6.

Referring to the drawings, it will be noted that the method and apparatus of the invention involves advancing a strip of material through a plurality of work stations which progressively deform portions of the strip. FIGS. 1 and 2 represent respectively the general configuration of the strip material as a result of the operation at a particular work station and the associated work station producing such a configuration. From FIGS. 1 and 2, it will be seen that there are four such successive work stations shown as the preferred embodiment of the invention.

The various successive work stations will all include a die set having mating opposing working faces and which are configured to produce a plurality of slender finger contacts integrally connected to a base portion. As stated above, one of the common problems in producing an integral brush-type contact of an extremely small size is the fact that conventional shearing operations will not allow independent flexing of the fingers. The various die sets within the working stations of the invention will form fingers which will not tend to hang up or interfere with the independent flexing of one another. The invention described herein utilizes work stations, such as 22 and 24, which compress and diminish the width of the individual fingers as well as severing the fingers from one another. A subsequent station, such as 26, may be utilized following the forming stations 22 and 24 and totally confine each individual finger along its length and also accurately size and form adjacent edge surfaces of the fingers into configurations which will provide essentially no interference to independent flexing.

An example of the size of contact members which may be produced using the method and apparatus of the invention will serve to point out the criticality of various aspects of the invention. A multifinger integral contact member having individual fingers with an individual width of approximately .005 inch and length of .075 inch may be produced utilizing the teachings of this invention.

Turning now to FIG. 2, the details of the various successive work stations will be presented with particular reference to the results of the deformation accomplished at each station.

A first work station 20 may be provided to initially define the elongated portions 12 to be formed on a work strip 10. The definition and location of the fingers 12 may be accomplished by a pair of opposing tool portions with working faces aligned so that opposing slender elongated die cavities 32 and 34, as well as thin wall portions 36 and 38 in upper and lower tool portions 28 and 30 respectively, will be accurately aligned. The station is designed so that the edges of the wall portions will not abut so the edges will serve to score but not completely penetrate the strip 10, locating the fingers 12 wherein they may thereafter be deformed and severed.

The second station 22 will also include a pair of opposing tools 40 and 42. The work faces on these tools however will include a series of alternately arranged die cavities 44 and punches 46 in the upper tool 40 as well as die cavities 48 and punches 50 in the lower tool 42. The punches 46 in the upper tool will be aligned with the die cavities 48 and likewise the punches 50 will be aligned with cavities 44 and will thus mate so that the punches may extend a limited distance within the cavities. It will be noted that the cavities 48 and 44 decrease in width from the mouth of the cavity to the bottommost portion of the cavity and the bottommost portion of the cavity is preferably of an arcuate shape. The mating punches 46 and 50 will increase in width from the working face to the base of the punch.

FIG. 3 represents the condition of the strip as a result of the work performed at station 22. It will be seen that the punches 46 will deform alternate finger portions 12 out of the plane of the remaining finger portions. As the tool portions 40 and 42 are mated, each individual finger portion 12 will be compressed into a cavity 44 and 48 and since the cavity is of decreasing width, the finger portion resulting will likewise be of a decreasing width. The slender elongate portions 12 may remain interconnected along their length through a web 13 following the operation at this station.

At a third station 24, cooperating upper and lower tool portions 52 and 54 are provided having working faces substantially identical to the preceding station 22. However, it is to be noted that the relative positions of the die cavities 56 and punches 58 on upper tool 52 are reversed from the positionment of die cavities 44 and punches 46 in the preceding upper tool 40. Likewise, the relative positions of die cavities 60 and punches 62 in lower tool 54 are reversed from the positions of die cavities 48 and punches 50 in the preceding lower tool 42. It will be apparent, therefore, that the alternate fingers 12 that were deformed in one direction in tool station 22 will now be deformed in the opposite direction in tool station 24. This is shown by comparing the configuration of the stock in FIG. 4 with the configuration of the stock in FIG. 3. Since the die cavities 56 and 60 in station 24 are also of decreasing width towards the bottom of the cavities, the resulting fingers will likewise be decreased in width during this operation as well as in the preceding station. The two directions of deformations performed successively by stations 22 and 24 will allow the deformation at station 24 to completely sever adjacent fingers 12 from one another without the formation of burrs on opposing edges of adjacent fingers. It will be noted that the fingers 12 will be separated from one another at a portion that will be compressed in a die cavity 56 or 60. Thus any burrs or irregularities along the length of the fingers caused by the shearing will tend to be eliminated in the deformation process of station 24. As shown in the appropriate portion of FIG. 1 as well as FIG. 4, the adjacent fingers 12 will be slightly spaced from one another as a result of the compression into die cavities of decreasing width and following the severing of station 24.

A final work station 26 will include upper and lower tools 64 and 66 which may be identical to the tools utilized in station 20. The working face of the upper tool 64 will include a plurality of closely adjacent shallow die cavities 68 separated by a thin wall or ridge 70. The tool face of the lower tool 66 will include shallow elongate die cavities 72 separated by thin wall portions 74. The die cavities 68 and 72 as well as the wall portions 70 and 74 will be aligned so that the edges of the wall portions will abut when the tools are in mating condition. The die cavities 68 and 72 may be substantially identical and be of an arcuate configuration so that the mating tool faces will provide a generally oval shaped cavity. It will be particularly noted that the abutting edges of the walls 70 and 74 will totally confine adjacent finger portions 12 from one another. Due to the continuously arcuate configuration presented by the opposing die cavities, the resulting fingers will have opposing side edges 82 which are curved away from one another as well as being slightly spaced, as at 80 in FIG. 5, as a result of previous compression steps and the confinement step in the station 26. The plurality of finger portions 12 may be returned to a coplanar position as well as with the associated base portion 14 as a result of work station 26 or separate work station interposed between stations 24 and 26.

Following a final deformation step at station 26, the strip may be selectively severed to produce a plurality of integral multifinger contact members such as that shown in FIG. 6. Each contact member will include a base portion 14 and a plurality of densely arranged fingers 12 emanating therefrom. The fingers will have a generally curved surface at opposing side edges to substantially minimize the potential binding or interfering lateral contact between adjacent fingers. The various compression and forming steps performed by the invention may also serve to work harden each finger as well as providing a slight spacing between each finger.

Thus, it is apparent that there has now been provided a method and apparatus for producing a novel, integral, multifinger brush contact in accordance with the objects and advantages of the invention. While the invention has been described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

I claim:

1. An integral, one piece, multifinger electrical contact member formed from a single sheet of conductive material, the contact member including a base portion, a plurality of elongate resilient contact fingers having individual widths and lengths of approximately .005 inch and .075 inch respectively, emanating from and forming uninterrupted slender extensions of one end of the base and densely arranged thereon, each finger having a generally arcuate surface forming the opposing longitudinal edges on adjacent fingers whereby the fingers are free to flex essentially independent of one another.

2. The contact member of claim 1, wherein the cross-sectional configuration of the fingers is that of a closed curve.

* * * * *